US005343709A

United States Patent [19]

Kohler

[11] Patent Number: 5,343,709

[45] Date of Patent: Sep. 6, 1994

[54] CRYOPUMP

[76] Inventor: Marcel Kohler, Egerta 517, FL-9496 Balzers, Liechtenstein

[21] Appl. No.: 93,744

[22] Filed: Jul. 20, 1993

[30] Foreign Application Priority Data

Jul. 21, 1992 [CH] Switzerland ..... 02299/92

[51] Int. Cl.[5] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,797,264 | 3/1974 | Thibault et al. | 62/55.5 |
| 4,072,025 | 2/1978 | Thibault | 62/55.5 |
| 4,117,694 | 10/1978 | Belmore | 62/55.5 |
| 4,285,710 | 8/1981 | Welch | 62/55.5 X |
| 4,531,372 | 7/1985 | Slabaugh | 62/55.5 |
| 4,803,845 | 2/1989 | Strasser et al. | 62/55.5 |
| 4,815,303 | 3/1989 | Duza | 62/55.5 |

FOREIGN PATENT DOCUMENTS

| | | | |
|---|---|---|---|
| 239383 | 10/1988 | Japan | 62/55.5 |
| 106979 | 4/1989 | Japan | 62/55.5 |
| 294976 | 11/1989 | Japan | 62/55.5 |
| 206376 | 9/1991 | Japan | 62/55.5 |
| 1268827 | 11/1986 | U.S.S.R. | 62/55.5 |
| 2182101 | 5/1987 | United Kingdom | 62/55.5 |

OTHER PUBLICATIONS

Dermois, O. C.; Schmitd, P. W. "A 20K cryopump with a high conductance baffle design", *Vacuum,* vol. 30, No. 10 pp. 411–414, 1980.

*Primary Examiner*—Henry A. Bennett
*Assistant Examiner*—Christopher Kilner
*Attorney, Agent, or Firm*—Jones, Tullar & Cooper

[57] ABSTRACT

A cryopump includes a housing in which is mounted a cooling head having a first, 80° K. cooling stage and a second, 20° K. cooling stage. A shield mounted on the cooling head surrounds the two stages, and a cooling surface within the housing and within the shield surrounds the second stage. The housing and the shield include corresponding inlet openings for admitting gases, and a diaphragm protects the cooling surface from heat radiation entering the inlet openings. The diaphragm is closer to the cooling surface than is the shield, creating a transfer opening that permits free access of gases into the volume within the shield. The cooling head can be rotated by an adjustment motor to displace the shield inlet opening with respect to the housing inlet opening to control the suction capacity of the pump for process gases without the need for an additional reduction valve, while maintaining the capacity for processing water vapor.

11 Claims, 3 Drawing Sheets

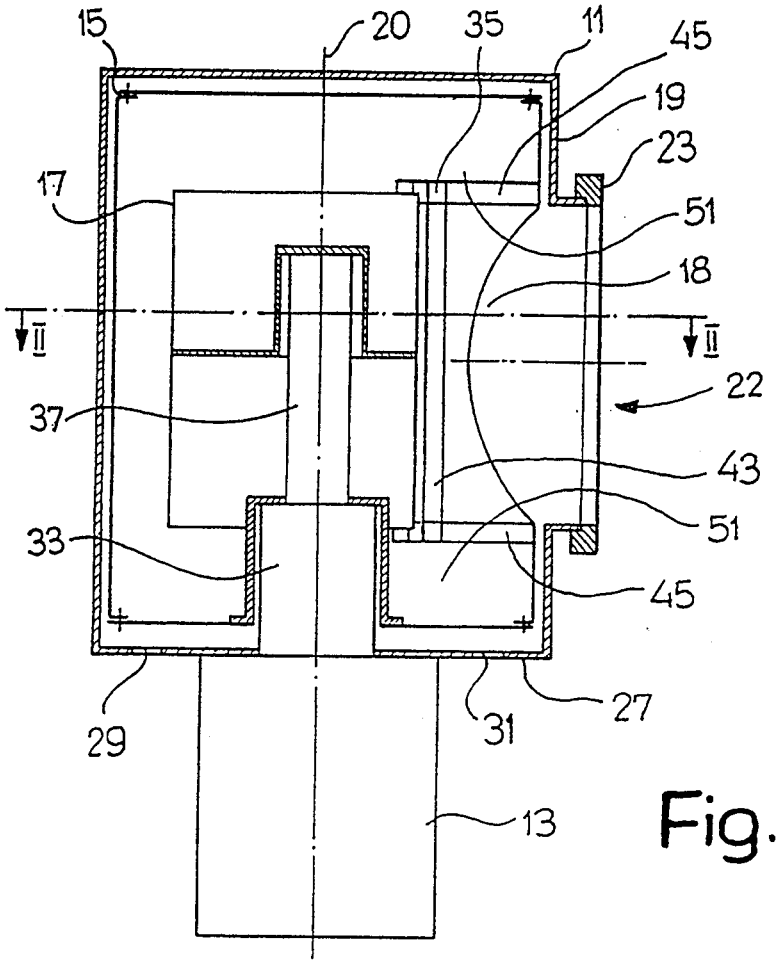
Fig.1
Fig.2
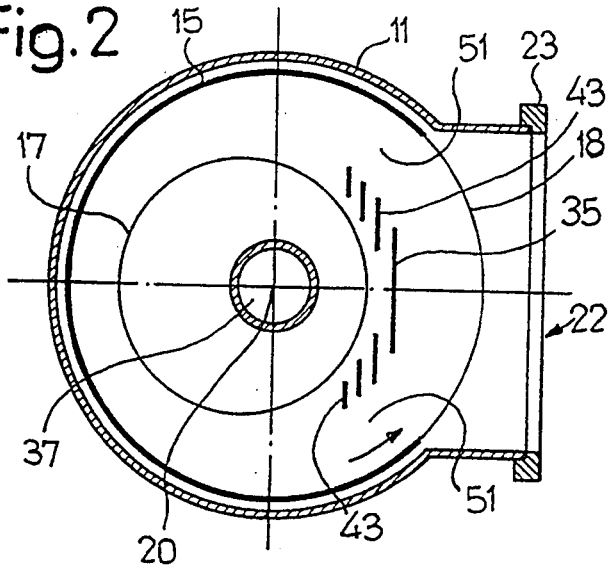
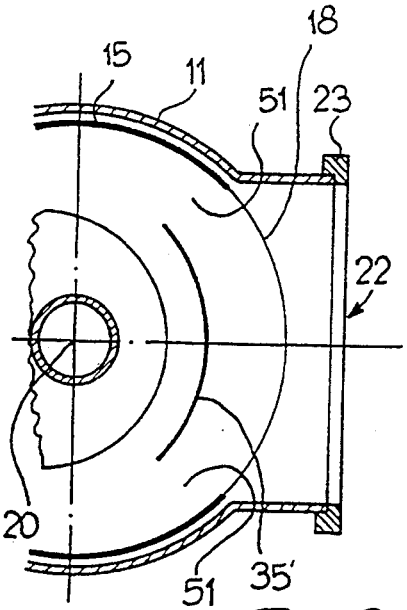
Fig.3

CRYOPUMP

BACKGROUND OF THE INVENTION

The invention relates to a cryopump with a housing that incorporates an intake opening, a two-stage cooling head in the housing, at least one cooling surface that is connected to the two-stage cooling head, a screen, and a shield that is connected to the first stage to act as radiation protection for the cooling surface of the second stage.

Cryopumps for vacuum technology generally have two levels with a cooling surface. With few exceptions all gases are condensed on this cooling surface. As a rule an outer cooling surface that acts as a shield against heat radiation is kept at about 80° K., and an interior cooling surface is kept at a temperature level of 20° K. With the exception of an opening for the input of gases, the shield surrounds the interior cooling surface. This opening is enclosed by a diaphragm consisting of segments. The diaphragm reduces the radiation of heat and thus reduces the thermal load on the interior cooling surface. The temperature level of the interior cooling surface would be elevated about 20° K. with a direct exposure to heat. That would interfere with the absorption of gases with low molecular weight in such a way that the desired pump action could not be achieved for those gases.

Conventional diaphragms are made of concentrically placed sheet-metal rings, also known as chevrons. These are sheet-metal baffles of parallel, V-shaped sheet-metal strips that do not optically seal the interior cooling surface. Such diaphragms have the disadvantage that they impede the transport of the gas the disadvantage that they impede the transport of the gas molecules that are to be condensed or absorbed. On the other hand, a resistance-free transport of the gas molecules—in this case this is considered a high conductance—would result in maximum suction capacity of the cryopump.

In prior art cryopumps, the diaphragms were shaped to obtain an optimal compromise between admitting minimal heat radiation on the one hand and on the other hand obtaining maximum conduction, so that the cryopump would retain an equivalent suction capacity. However, a disadvantage of prior art cryopumps is that their suction capacity is considerably below the theoretically possible value. Cryopumps of the prior art also have the disadvantage that they have an extended structural, or construction, length or a large structural depth.

Many vacuum processes; for example, sputtering, use process gases. In such applications, an adjustable, stepless reducing valve is generally placed between the cryopump and the vacuum chamber so that the cryopump is not overloaded by high gas flow. The reducing valve is controlled by corresponding vacuum pressure sensors to seal the access of gas to the cryopump during specific process steps. However, that has the disadvantage that vapors harmful to the vacuum process, such as water vapor, cannot continually be pumped off in adequate quantity from the cryopump out of the vacuum process chamber. Such a valve therefor presents a tremendous disadvantage.

SUMMARY OF THE INVENTION

The object of this invention is to at least in part avoid the disadvantages of prior art cryopumps by creating a cryopump that has a high performance value without compromising the thermal protection to the 20° K. cooling surface.

A further object of this invention is to create a cryopump that has a reduced construction length and that is suitable for compact vacuum systems.

Another object is to create a cryopump that no longer requires a separate reduction valve for use with processes with high gas flows, such as during sputtering and discharging in coating systems, so that suction capacity for water vapor will be maintained during a reduction of the suction capacity for process gases.

A cryopump according to this invention includes a housing having an input opening and a two-stage cooling head in the housing. At least one cooling surface is connected to the second stage of the cooling head and a shield surrounds the cooling surface. The shield includes a gas input opening, with a diaphragm being connected in the opening to provide radiation protection for the cooling surface. The device is characterized by the fact that there is a transfer opening between the shield and the diaphragm to allow for the free access of the gas from the input opening. The cooling surface of the second stage is optically tightly sealed since the diaphragm has the same or a larger profile than the input opening. On the other hand the optically unsealed access opening allows direct access of gases to the cooling surface of the second stage. The cryopump according to this invention therefore has high conductance and thus an equivalently high suction capacity. Contrary to the state of the art the invention allows the use of a diaphragm that is made of the simplest piece of sheet-metal. Such a diaphragm is much cheaper than diaphragms of the prior art with chevrons or strips.

For practical purposes the input opening is preferably at a right angle to the axis of the pump. This results in a short construction length so that the cryopump is suitable for vacuum systems that are very compact.

The cryopump is advantageously characterized by the fact that the shield is in the form of a cylindrical shell that is enclosed at either end, that has an input opening facing the housing input opening, and that the diaphragm shields the cooling surface of the second stage from the shield input opening. This results in a very simple construction. For practical purposes the diaphragm is nearer the cooling surface of the second stage that is the shield. This is a simple way to create an unrestricted transfer opening for the gases, and this construction is economical in production. As already mentioned, the diaphragm may be a sheet-metal diaphragm, also resulting in a very inexpensive construction. The diaphragm may also be formed of strips that are placed at short distances from each other, resulting in greater suction capacity in comparison to a diaphragm in the form of a sheet-metal sheet. This construction, contrary to common chevrons, is very simple and economical.

The cooling surface of the second stage is preferably formed by a cylindrical skirt. The diaphragm can then be placed concentric to the cooling surface of the second stage, resulting in a simple and practical design of the cryopump.

A particularly advantageous embodiment of this invention provides for the shielding and the housing to be adjustable relative to each other and for the opening in the shield to be adjustable relative to the housing input opening. That makes it possible to effect a flow reduction without an additional reduction valve. Contrary to the use of the reduction valve that reduces the suction capacity even for process damaging gases by a reduction of the profile, the use of the cryopump according to the above described characteristics only reduces the suction capacity of the process gases. Variations of the preferred embodiment are possible. There may, for example, be an adjustment device to turn the shield in the housing. Another variation provides an adjustment device for the axial displacement of the shield in the housing. Both structures are relatively simple.

BRIEF DESCRIPTION OF THE DRAWINGS

The foregoing, and additional objects, features and advantages of the present invention will be apparent to those of skill in the art from the following detailed description of preferred embodiments thereof, taken with the accompanying drawings in which:

FIG. 1 is a sectional view of a first embodiment of the cryopump according to this invention;

FIG. 2 is a cross-section along line II—II of FIG. 1;

FIG. 3 is a partial cross-section along line II—II of FIG. 1, illustrating a variation of the embodiment of the diaphragm in FIG. 2;

DESCRIPTION OF PREFERRED EMBODIMENTS

Figure 4:
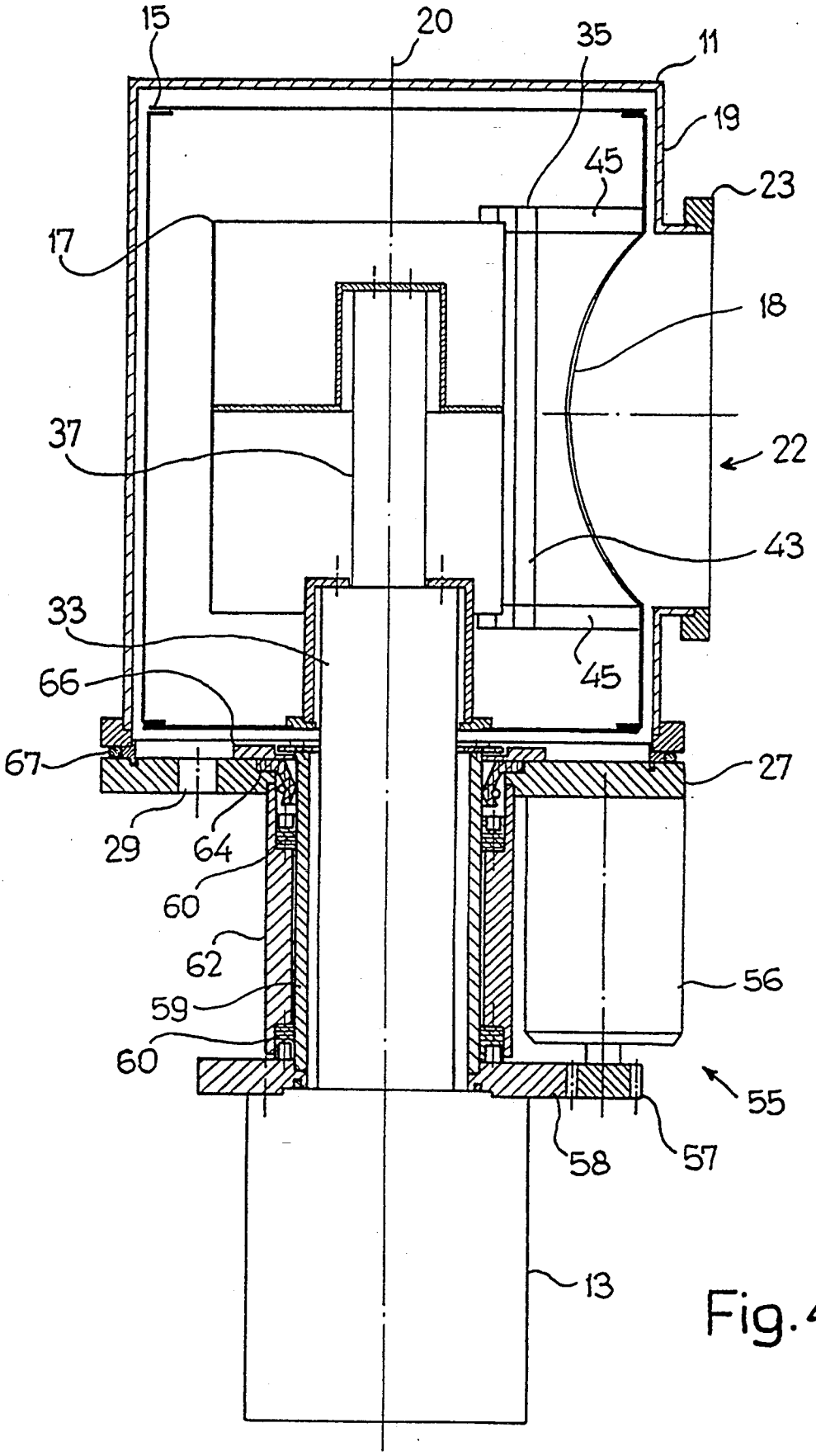
FIG. 4 is a sectional view of a cryopump as shown in FIG. 1, but with an adjustable cooling head.

The cryopump 10 of the present invention as illustrated in FIGS. 1 and 2 has a housing 11 which with an input opening 22. Housing 11 has a two-stage cooling head 13 which includes a first stage 33 having a cooling surface that is kept at 80° K. or less. A second stage 37 has one or more cooling surfaces that are kept at 20° K. or less. Cooling surface 17 of the second stage is covered by a sorbent, such as active charcoal, that is necessary for the pump where gases such as hydrogen, neon and helium that are not condensed at 20° K., are to be pumped.

Housing 11 is a cylindrical pipe 19 that surrounds stages 33 and 37 and cooling surface 17, and includes a connection flange 23 that is mounted on housing opening 22 and has an axis at a right angle to the axis 20 of the cooling head. The lower end of the housing 11 is sealed with a flange 27 to which the cooling head 13 is attached. Connections 29, 31 may be used to attach measuring devices and pump connection pieces.

Cooling head 13 has two cooling steps, or stages, that produce different temperatures. A shield 15 is connected to the first cooling stage 33 and encloses the cooling surface 17 on the second cooling stage 37 almost completely, leaving shield opening 18 which faces opening 22. Opposite the input opening 22 that is formed by connection flange 23 is a diaphragm 35 positioned to prevent direct heat radiation by way of the input opening 22 onto the cooling surface 17. The temperature level of cooling surface 17 would, in the absence of diaphragm 35, be increased to such an extent that the absorption of gases with low molecular weight would not be adequate.

As illustrated in FIGS. 1 and 2, diaphragm 35 includes a first flat sheet aligned with opening 22, parallel to axis 20, and connected at its ends to, and thermally coupled to shield 15 by way of connectors 45. In addition, the diaphragm includes a series of parallel, spaced strips 43, also secured to connectors 45. The strips are offset outwardly and rearwardly from each other and from the axis of opening 22 and cooperate with the first sheet to provide a diaphragm which is about the same dimensions as inlet opening 22 and which thereby effectively shields the cooling surface from heat radiation into inlet opening 22. As illustrated in FIG. 2, the diaphragm strips 43 are positioned along a generally curved path concentric with cooling stage 37 to shield the cooling surface 17 from any "line of sight" direct heat radiation, while allowing free flow of gas through transfer openings 51 and between the spaced strips 43. The first flat sheet and the strips 43 which make up the diaphragm 35 may be of sheet metal.

As illustrated in FIG. 3, the diaphragm may, in the alternative, be formed as a single, curved sheet 35' coaxial with cooling stage 37 and interposed between surface 17 and inlet 22. This single sheet 35' is also connected to the shield 15 by connectors 45, and is very economical. However, this structure does not include the gas flow paths which the structure of FIG. 2 provides between the adjacent strips 43, but only permits flow around the diaphragm through transfer openings 51 between the diaphragm and the shield 15. The transfer openings 51 do allow free access of gases into the interior of the shield 15 so that the cryopump has a large conductivity, however.

The opening 51 between diaphragm 35 and shield 15 permits maximum access of the gas molecules to the cooling surface 17 without direct heat radiation from the input opening 22 to the cooling surface 17. Opening 51 allows the cryopump to have high conductance so that it has a considerably higher molecular suction capacity that cryopumps of the prior art.

The cryopump shown in FIG. 4 is almost identical to the pump in FIGS. 1 and 2, but further includes an adjustment device 55 by which cooling head 13 may be rotated with the interior cooling surface 17 and the outer cooling surface 15 around axis 20.

An examination of FIG. 2 shows that cooling head 13 with shield 15 as modified in FIG. 4 can be rotated by the adjustment device 55 so that inlet 18 moves out of alignment with the input opening 22, providing a stepless control of the gas access to the interior cooling surface 17. The suction capacity for water vapor is completely maintained in every position since no reduction valve is used that would reduce the profile of connecting flange 23.

The adjustment device 55 essentially consists of an adjustment motor 56 which is mounted on flange 27 of the housing 11. The motor 56 drives a toothed gear 57 which, in turn, engages and drives a toothed gear 58. Gear 58 is mounted on the bottom end of a tubular shaft 59 which is rotatably mounted by friction bearings 60 within a sleeve 62. The upper end of sleeve 62 is secured to flange 27, while the gear 58 and the inner rotatable shaft 59 are secured to cooling head 13 to rotate the cooling head about its axis 20. A seal 64 is attached on flange 27 with a ring 66 and screws (not shown), and a seal 67 is provided between the housing 11 and flange 27 in FIG. 4.

Figure 5:
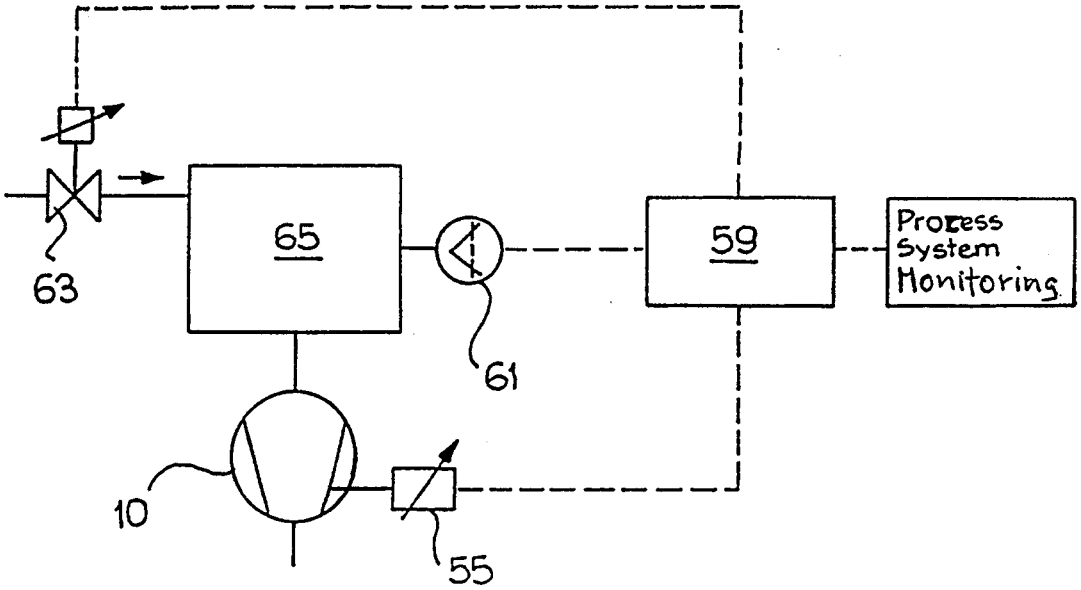
FIG. 5 is a basic diagram of a vacuum pump system.

FIG. 5 is a diagram of a process system, such as a load lock sputter system with a cryopump 10, in which the suction capacity of the process gases can be reduced with the adjustment device 55 without reducing the suction capacity for process damaging water vapor. The process of the cryopump can be adjusted with a pressure meter 61 on adjustment device 59 or one or more gas input valves 63 so that the process parameters are maintained without the addition of a reduction valve between the cryopump 10 and the process chamber 65. This protects the cryopump from overload and the use of process gases is greatly reduced.

Although the invention has been described in terms of preferred embodiments thereof, it will be understood that variations and modification may be made without departing from the true spirit and scope thereof, as defined in the following claims.

What is claimed is:

1. A cryopump comprising:

a housing having a first input opening;

a cooling head having first and second stages within said housing;

at least one cooling surface connected to said second stage;

a shield for said cooling surface, said shield having a second input opening;

a diaphragm mounted within said housing and thermally coupled to said shield, said diaphragm being interposed between said cooling surface and said second input opening to protect said cooling surface from radiation entering said first input opening; and means for adjusting said shield with respect to said housing to adjust the relative positions of said first and second input openings.

2. The cryopump of claim 1, wherein said cooling head has an axis, and wherein said first input opening has an axis perpendicular to said cooling head axis.

3. The cryopump of claim 2, wherein said shield is cylindrical, is coaxial with said cooling head axis, and is closed at its axial ends, said second input opening in said shield facing said first input opening.

4. The cryopump of claim 1, wherein said second input opening generally faces said first input opening.

5. The cryopump of claim 1, wherein said diaphragm is a single sheet of metal.

6. The cryopump of claim 1, wherein said diaphragm is a plurality of offset, spaced metal strips.

7. The cryopump of claim 1, wherein said cooling surface is coated with an absorption material.

8. The cryopump of claim 7, wherein said cooling surface is cylindrical.

9. The cryopump of claim 8, wherein said diaphragm is generally concentric with and spaced from said cylindrical cooling surface.

10. The cryopump of claim 1, wherein said means for adjusting includes means for moving said second input opening relative to said first input opening.

11. The cryopump of claim 10, wherein said means for moving includes means for rotating said shield with respect to said housing.

* * * * *